US006824122B2

(12) United States Patent
Spyrakis

(10) Patent No.: US 6,824,122 B2
(45) Date of Patent: Nov. 30, 2004

(54) CLIP FOR SECURING FENCING TO SUPPORT STRUCTURES

(76) Inventor: Andrew Spyrakis, 70 Minimine Street, Stafford, Queensland, 4053 (AU)

( * ) Notice: Subject to any disclaimer, the term of this patent is extended or adjusted under 35 U.S.C. 154(b) by 33 days.

(21) Appl. No.: 09/964,569

(22) Filed: Sep. 28, 2001

(65) Prior Publication Data

US 2002/0038865 A1 Apr. 4, 2002

(30) Foreign Application Priority Data

Sep. 29, 2000 (AU) ..... PR0498

(51) Int. Cl.[7] ..... E04H 17/16

(52) U.S. Cl. ..... 256/47; 256/19; 256/24; 256/1

(58) Field of Search ..... 256/19, 24, 25, 256/45, 47, 50, 5, 54; 248/65, 71, 74.1, 74.2, 216.1

(56) References Cited

U.S. PATENT DOCUMENTS 3,820,758 A * 6/1974 Berg ..... 256/47 X
4,049,905 A * 9/1977 Maranell
4,077,611 A * 3/1978 Wilson ..... 256/47 X
4,688,302 A * 8/1987 Caveney et al. ..... 248/74.2 X
D300,423 S * 3/1989 Reeves
4,840,334 A * 6/1989 Kikuchi ..... 248/74.2 X
5,180,143 A * 1/1993 Brower ..... 256/24
5,676,351 A * 10/1997 Speece et al. ..... 256/47 X
5,765,786 A * 6/1998 Gretz ..... 248/74.2 X
5,816,543 A * 10/1998 Kraus ..... 248/74.1 X
6,095,503 A * 8/2000 Burley et al. ..... 256/24
6,149,135 A * 11/2000 Hlavin ..... 256/24
6,206,606 B1 * 3/2001 Mita et al. ..... 248/71 X
6,344,617 B1 * 2/2002 Berto ..... 256/19 X
6,371,419 B1 * 4/2002 Ohnuki ..... 248/74.2

FOREIGN PATENT DOCUMENTS

GB 2323108 A * 9/1998 ..... A01K/3/00

* cited by examiner

*Primary Examiner*—Lynne H. Browne
*Assistant Examiner*—Ryan M. Flandro
(74) *Attorney, Agent, or Firm*—Young & Thompson

(57) ABSTRACT

A clip (10) is provided for securing fencing (12) to a support structure (14) having at least one vertically extending structure member (18) with opposed edge surfaces (38). The clip (10) includes a main body portion (22) having a first (22*a*) and second (22*b*) surface, attachment arrangement (24) extending from the first surface (22*a*) and being adapted for removably engaging to the edge surfaces (38) of the support structure member (18), and retaining arrangement (26) extending from the second surface (22*b*) configured for removably supporting the fencing (12) relative to the support structure (14).

35 Claims, 4 Drawing Sheets

CLIP FOR SECURING FENCING TO SUPPORT STRUCTURES

CROSS-REFERENCE TO RELATED APPLICATIONS RECEIVED

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

This invention relates to a clip, method and system for securing fencing to a support structure, and in particular, but not limited to, a clip, method and system usable in temporary fencing arrangements for securing a barrier netting for fencing to an apertured fence post as the support structure.

Temporary fencing is utilised in a variety of applications, for example including, inter alia, as a barrier within and around work areas in construction sites, as warning fences near excavation sites and road works, as protective fencing for preventing unauthorized entry in developing gardens and areas for vegetation, and for limiting human thoroughfare to erosion-susceptible land areas.

Typically, fence systems of this nature require assemblage from a multiplicity of component parts which include fencing, fence posts and, optionally, post supports. To facilitate assemblage, various tools may be required along with other articles for coupling the parts together. Labour is a further expenditure in this assembling process.

Known prior art means and methods for fastening fencing to fence support structures aim to improve ease and expenditure associated with both assemblage and disassemblage of the fence system. These disclosures span the gambit from simple string tying, stapling or tacking together of parts, to more complicated multi-part attachment devices.

However none of these prior art attempts appear to be adequate solutions, as most commonly, the old problematic method of using string to tie the fencing to the fence posts is resorted to. However this technique is time consuming. Each string piece must be threaded through a fence post aperture and then individually tied to a section of fencing. Moreover, because of the necessary untying, this process is not easily reversible, which is a particular disadvantage in construction applications where the fence must continually be adapted, for example partially disassembled and reassembled to allow for the passage of workmen or for sections to be enlarged and so on to accommodate an evolving construction. A further disadvantage is that sections of the fencing which have been tied in this manner can become worn and unsuitable for reuse.

It is therefore desirable to provide a means and method to enable a fencing system to be easily assembled and disassembled, which further, requires relatively few parts, accessories or tools to accomplish this, and for the particular means to be reusable and preferably securable to the fencing system when not in use.

It is therefore an object of the present invention to provide a clip, method and system for securing fencing to support structures therefor, which alleviates, at least to some extent, one or more of the aforementioned problems of the prior art.

BRIEF SUMMARY OF THE INVENTION

In one aspect therefore the present invention resides in a clip for securing fencing to a support structure having at least one vertically extending structure member with opposed edge surfaces. Said clip includes a main body portion having a first and second surface, attachment means extending from said first surface and being adapted for removably engaging to at least one edge surface of said support structure member, and retaining means extending from said second surface, said retaining means being configured for removably supporting the fencing relative to the support structure.

In preference, said clip further includes a first bracing means connected between the first surface and the attachment means for providing a bracing support to the attachment means. It may also includes a second bracing means connected between the second surface and the retaining means for providing a bracing support to the retaining means. As such the attachment means and the securing means have a substantially improved structural strength and are thereby substantially stiffened.

The attachment means of the clip may have an engagement arrangement for removably engaging said at least one edge surface. Preferably, the attachment means further includes securing means for removably securing the engagement arrangement in position relative to the support structure. In one form the engagement arrangement has a recess adapted for receiving said opposed edge surfaces. Suitably the recess is formed between two spaced arms extending from said first surface. The spaced arms can be configured as a bifurcation or other suitable construction to be adapted for press-fitting engagement with the edge surfaces of the support structure member. In one form said first bracing means includes a bracing element connected between each of the spaced arms and the first surface.

Each said spaced arm may have an area with a reduced thickness and each said bracing element extends from said area to the first surface. The reduced areas allows less material needed for the spaced arms, while the bracing elements provide improved structural strength to the clip.

In preference, the securing means is arranged to be co-operable with the engagement arrangement for removably fixing the clip in position relative to the support structure. The bifurcation may comprise two web-like extensions with said recess therebetween and having aligned bores therethrough. The aligned bores are suitably adapted to receive the securing means. The securing means is preferably dimensioned for tight-fitting removable containment and retention within the said aligned bores. An appropriate securing means may include an elongate member, suitably in the form of a push pin, which may be detachable connected to the main body portion or, more preferably, integrally formed with a cord-like extension. The cord-like extension can have enlarged sections where it is formed with the elongate member. The enlarged sections allow the securing means to remain attached to the main body portion and the elongate member even after repeatedly use thereof for a substantially longer period. Typically the elongate member is slightly longer than the external dimension between the spaced arms so that a certain length thereof is exposed when fully inserted.

The retaining means desirably has a support portion upon which the fencing may be supported on, and a retainer portion adapted for restricting movement of the fencing relative to the support structure therefor. The second bracing means may be in the form of a buttress element connected between the second surface and the support portion and/or the retainer portion. A suitable retaining means comprises an upwardly extending support arm for supporting the fencing and a downwardly extending retainer arm for restricting fencing movement.

In a preferred application of the invention the clip is suited to securing fencing in the form of a lightweight flexible fencing material, to the support structure in the form of rigid fence posts. An ideal fencing material, such as barrier netting, well known and used within the art, is meshed or incorporates a plurality of openings which facilitate attachment to the support structure by use of the retaining means. Appropriate support structures include fence posts and stakes, and most preferably those which include substantially planer cross-sectional edges for receiving the attachment means, and further, have a plurality of vertically spaced apertures for the clip to be secured to the support.

In a preferred mode of operation, the clip attachment means is removably push-fitted onto an edge surface of the support structure. Said support structure member may have a plurality of spaced apertures. The bores in the respective arm members or web-like extensions are aligned on both sides of the support structure edge surfaces to overlap with a selected aperture thereon to define a channel through the three sections into which the securing means may be inserted. When so positioned, the retaining means should project forwardly from the support for coupling with the fencing. The securing elongate member may then be inserted into the channel to secure the attachment between the clip and support structure. Where the cord extension is incorporated into the clip design it is desirably of sufficient length and flexibility to facilitate free movement of the flange for insertion in either direction through the channel. The fencing is then attached to the support by inserting each of the clip portions through one or more fencing openings.

Ideally a number of clips may be attached to an individual support structure, suitably at vertically spaced intervals therealong, so as to provide, in particular, multiple points of attachment and support of the fencing. The number of apertures on individual support structures and the number of openings in the fencing should be made sufficient for this purpose.

According to a preferred application of the present invention there is provided a fencing system including a plurality of spaced vertically positioned support structures, and a horizontally extending fencing body, said system characterised by a support arrangement comprising one or more of the aforementioned clips removably associated with each support structure for removably supporting the said fencing body across the plurality of support structures.

BRIEF DESCRIPTION OF THE DRAWINGS

In order that the invention may be more readily understood and put into practical effect reference will now be made to the accompanying drawings which illustrate a non-limiting preferred embodiment of the invention.

DETAILED DESCRIPTION OF THE INVENTION

Figure 1:
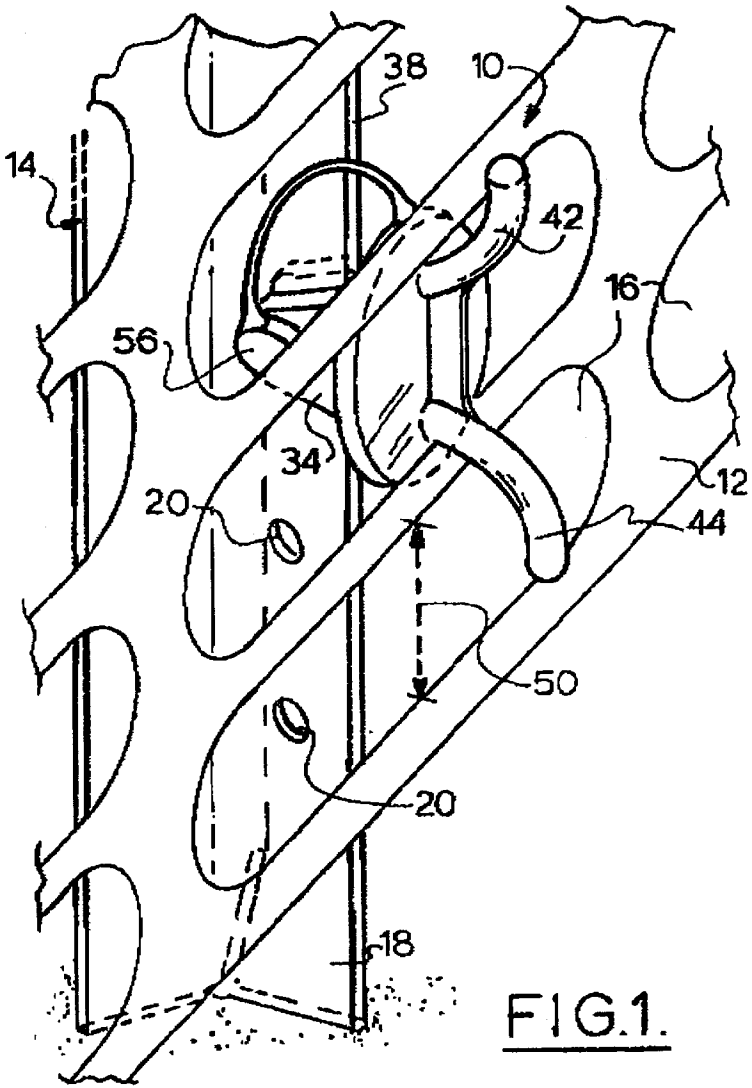
FIG. 1 is a partial perspective view illustrating the clip according to one exemplary embodiment of the invention securing barrier netting to a fence pos.
Figure 2:
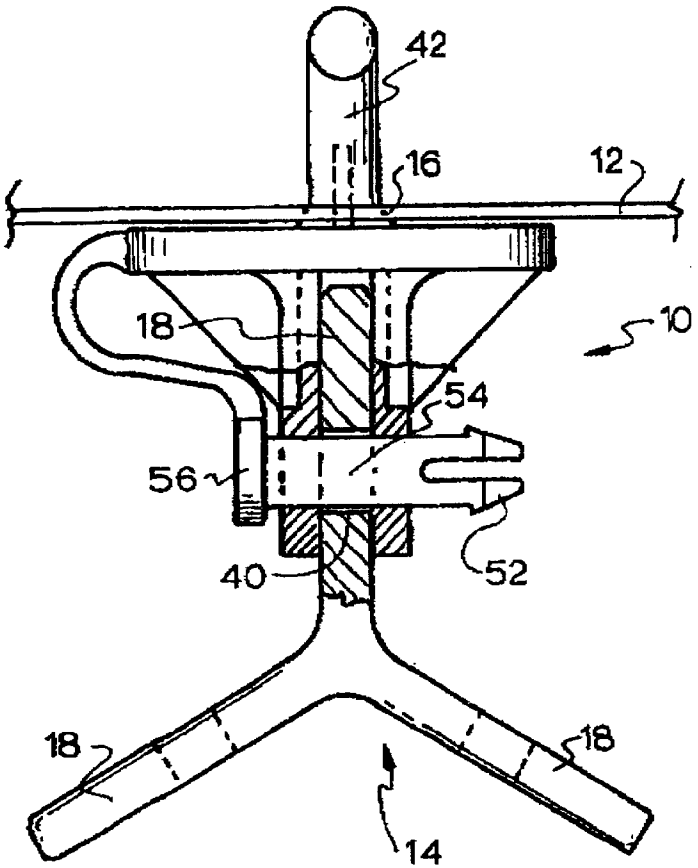
FIG. 2 is an enlarged cross-sectional top plan view of the clip, barrier netting and fence post arrangement illustrated in FIG. 1.
Figure 6:
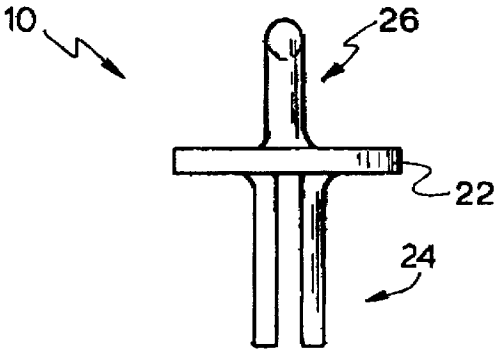
FIG. 6 is an enlarged end view of the clip in accordance with the invention (securing means not shown)
Figure 5:
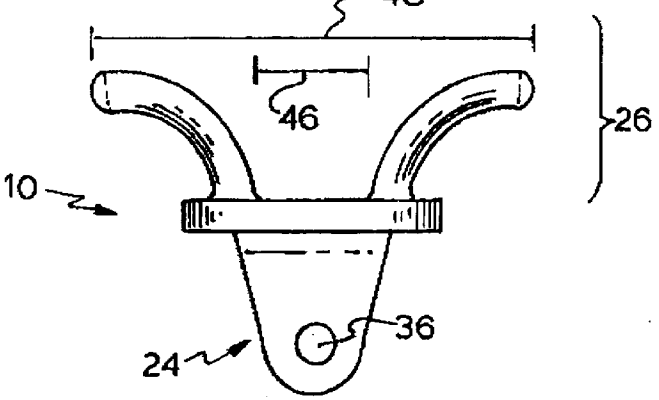
FIG. 5 is an enlarged side view of the clip in accordance with the invention (securing means not shown)

Referring to the drawings and initially to figures 1 and 2, a clip 10 according to one exemplary embodiment of the present invention is illustrated for securing a section of horizontally extending fencing 12 to a normally vertically orientated support structure 14 therefor.

The fencing 12, shown here in the form of barrier netting 12, is typically constructed of a flexible plastic material and has an array of openings 16 by which the fencing is securable.

The support structure 14 as shown is in the form of a fence post(s). The fence post(s) is referred to specifically as a "star post" by trades persons. It has characteristically three distinct panel or surface sections 18. The post 14 further includes a number of vertically spaced apertures 20 which are located along the length of each of the panels 18.

Figure 4:
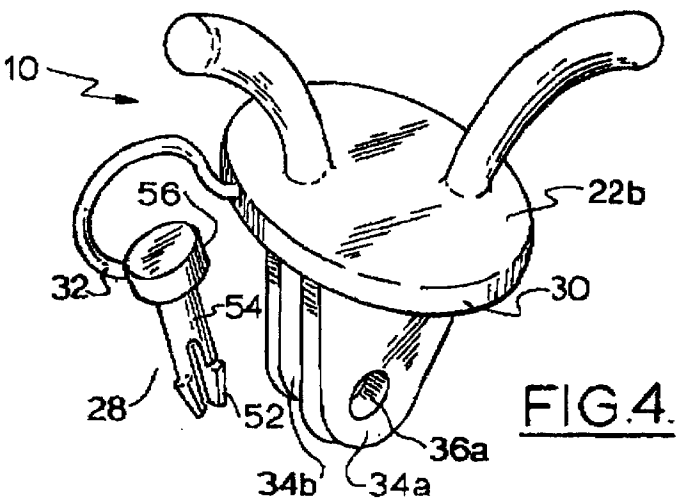
FIGS. 3 and 4 are different perspective views of the clip in accordance with the invention.
Figure 3:
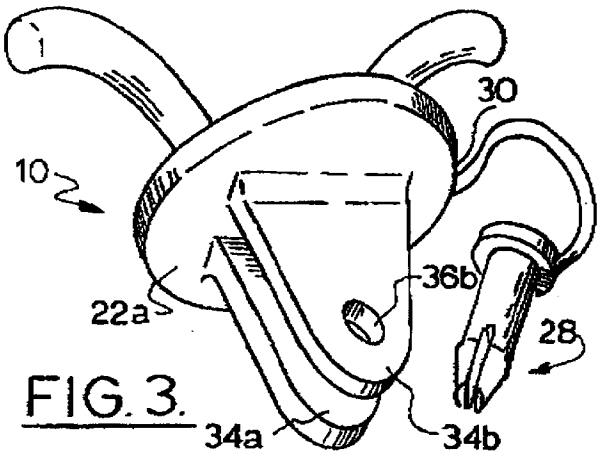
Figure 10:
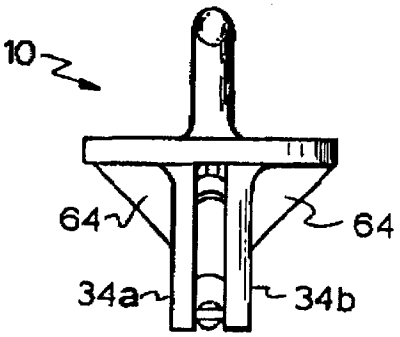
FIG. 10 is an enlarged end view of the clip shown in FIGS. 7 and 8.
Figure 9:
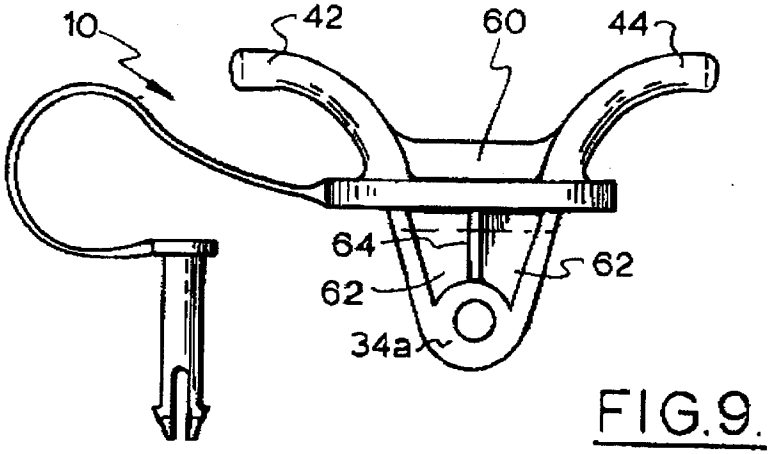
FIG. 9 is an enlarged side view of the clip shown in FIGS. 7 and 8.
Figure 8:
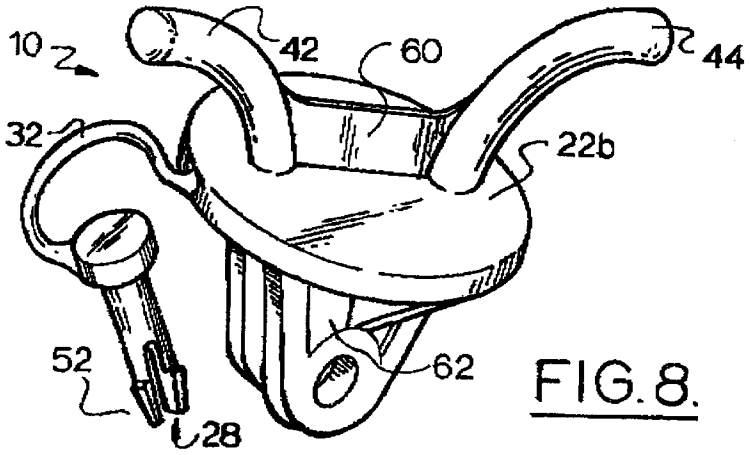
FIGS. 7 and 8 are perspective views of the clip in accordance with another embodiment of the present the invention.
Figure 7:
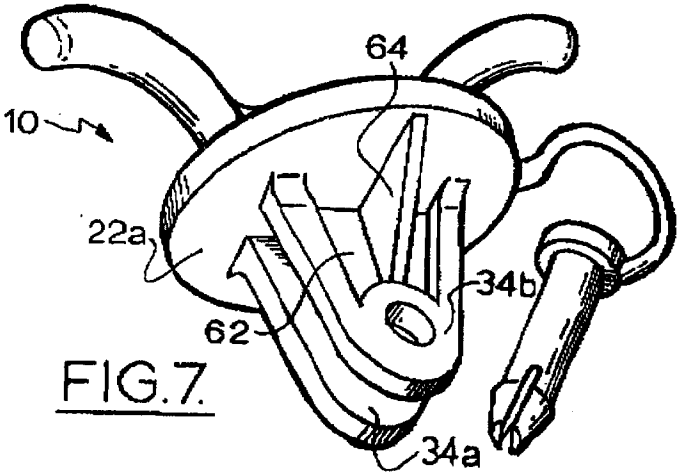

As best shown in FIGS. 3 and 4, the clip 10, constructed fully or predominantly from a plastic material, comprises a main body portion 22 in the form of a circular plate, having a first and second surface, 22*a* and 22*b* respectively, with attachment means in the form of a bifurcation 24 extending from the said first surface 22*a*, retaining means comprising a bracket assembly 26 extending from the said second surface, and securing means in the form of a push pin 28 shown here attached to a side surface 30 of the plate 22 by a flexible cord-like extension 32.

The bifurcated attachment means 24 is formed by two spaced opposed web-like extensions 34*a* and 34*b* having aligned bores 36*a* and 36*b*, respectively, therethrough. These extensions define a recess therebetween and are designed for receiving one of the panels 18 and for press-fitting engagement of the clip 10 to edge surfaces 38 of the panel 18 in the recess (refer back to FIGS. 1 and 2). The clip is somewhat slidable in this position so that it can be located with the respective extension bores 36*a* and 36*b* aligned over a fence post aperture 20 to form a channel 40.

As these figures show, the clip bracket assembly 26 has a single, substantially curve-shaped, upwardly extending support arm 42, and a single, substantially curve-shaped, downwardly extending retainer arm 44, extending from the plate's second surface 22*b*. With reference also to FIGS. 3 to 6, the distance 46 between the points of attachment of the distinct arm members 42 and 44 should not exceed the height 50 of an individual opening 16 in the barrier netting 12 to ensure it can be properly attached to the clip 10, whereas the distance 48 between the arm member free ends should be greater than this height 50 such that the barrier netting 12 can be properly retained by the clip 10.

The securing means in the form of a push pin 28, best illustrated in FIGS. 2, 3 and 4, is arranged in three distinct sections, namely, a tapered bifurcated front end section 52 which improves ease of insertion of the pin 28 into the channel 40 whilst hindering inadvertent release therefrom, an extended narrow mid section 54 and a broad tail end section 56 to which is attached the cord-like extension 32. The diameters of the pin front end 52 and mid 54 sections are approximated for sliding insertion of the pin into, and resilient extraction of the pin 28 from, the channel 40, whereas the tail end section 56 is of comparatively larger diameter to prevent full insertion of the pin through the channel.

In operation, for attachment of the clip 10 to the fence post 14, clip extensions 34*a* and 34*b* are brought into engagement with selected panel edge surfaces 38 of a panel section 18, then push-fitted for attachment thereto. Following attachment, the position of the clip 10 along the panel 18 can, if necessary, be adjusted to align bores 36*a* and 36*b* with a selected aperture 20 in the post. The clip 10 may be secured in position on the post 14 by use of the securing push pin 28 which inserts partially through either of bores 36*a* or 36*b* into the channel 40. Attachment of the barrier netting 12 to the clip 10 requires the bracket assembly 26 to be inserted through an appropriate opening 16 in the barrier netting 12 so that both the support 42 and retainer 44 arms thereof project through the opening 16 with the netting supported on arm 42 and retained from movement by arm 44.

Removal of the clip is generally the reverse procedure of the above assemblage process.

Turning to the embodiment of the clip 10 shown in FIGS. 7 to 10, as can be seen the clip 10 is substantially similar to the clip 10 described with reference to FIGS. 1 to 6. Accordingly the same numerical references used in the description with reference to the earlier embodiment are employed for the same or similar integers hereinafter, and it is believed that only differences between the two need to be included.

In this embodiment, the second bracing member in the form of a buttress or stiffening element 60 is provided to improve structural strength of the support arm 42 and the retainer arm 44. The buttress element extends from the second surface 22*b* and bridging the arms 42 and 44. Accordingly, deflection movement of the two arms 42 and 44 is substantially restricted and thereby providing improved retention of the fence 12.

Each of the extensions 34*a* and 34*b* has an area 62 with a reduced thickness. The first bracing means in the form of a bracing element 64 is interconnected between the first surface 22*a* and each of the extensions 34*a* and 34*b*. As such the structural strength or stiffness of the extensions 34*a* and 34*b* is also substantially improved even with the reduced thickness areas 62.

The cord-like extension 32 in this embodiment has enlarged sections at its ends which are formed with the body 20 and the pin 28 respectively. While not shown, it should be understood that the pin 28 is of such a length that its end section 52 is exposed when it is fully inserted through the apertures 36*a* and 36*b*.

Figure 11:
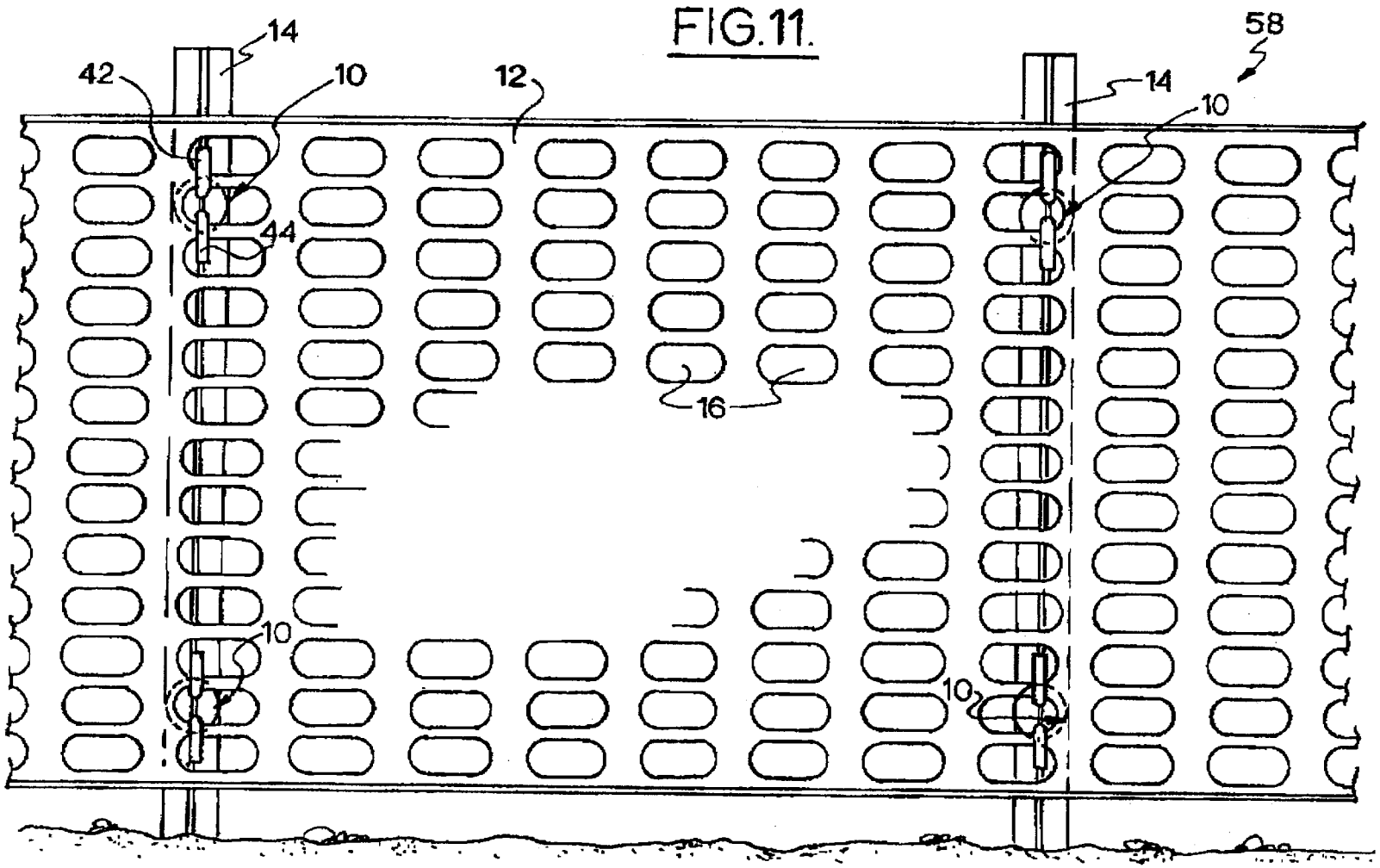
FIG. 11 is an enlarged graphic illustration showing fencing system using clips in accordance with the invention.

Referring now to FIG. 11, there is shown a partial view of a fencing system 58 comprising a section of horizontally extending barrier netting 12 supported across a plurality of spaced vertically positioned fence posts 14 (two shown here) by clips 10. As depicted in this illustration, it is preferable that a number of clips are employed with each post to properly secure the barrier netting. In the present illustration the barrier netting 12 is secured to each post at its upper and lower ends by clips similarly located on each post.

Whilst the above has been given by way of illustrative example of the present invention many variations and modifications thereto will be apparent to those skilled in the art without departing from the broad ambit and scope of the invention as herein set forth. For example it will be understood that the number of fence posts, fencing sections and clips per fence post used in the fencing system, may be varied as desired in accordance with end use requirements. Other variable factors include spacing between fence posts and the arrangement thereof, for example whether organised to form a straight line or circular fence and so on, fence post and fencing configuration and construction including aperture or opening sizes.

What is claimed is:

1. A clip for securing fencing to a support post having at least one vertically extending support structure member with opposed edge surfaces, the fencing being in the form of a flexible barrier netting with openings, comprising:

a main body portion having a first and second surface, attachment means extending from said first surface and having an engagement arrangement for removably engaging with at least one edge surface of the support post, and securing means for removably securing the engagement arrangement in position relative to the support post, the engagement arrangement having two spaced arms extending from said first surface and a recess formed between the spaced arms, the recess being adapted for receiving said edge surfaces when in engagement with said support post, first bracing means having a bracing element connected between each of the spaced arms and the first surface, and retaining means extending from said second surface, said retaining means being configured for removably supporting the barrier netting relative to the support post by engaging the retaining means with the barrier netting at a selected one of the openings, said retaining means having a curved support portion extending from said second surface to a free end in a first direction, and a curved retainer portion being spaced from said support portion and extending from said second surface to a free end in a second direction opposite to and in vertical alignment with said first direction, said support portion and said retainer portion being configured so that in engagement with the barrier netting both the support portion and the retainer portion extend through said selected one of the openings, and the free ends of the support portion and the retainer portion and the main body portion being adapted to confine movement of the fencing therebetween and thereby restricting movement of the fencing relative to the support post.

2. The clip according to claim 1, further including a second bracing means connected between the second surface and the retaining means for providing a bracing support to the retaining means.

3. The clip according to claim 2, wherein the second bracing means being in the form of a buttress element connected between the second surface and the support portion or the retainer portion.

4. The clip according to claim 1, wherein the spaced arms being a bifurcation adapted for press-fitting engagement with the edge surfaces of the support post.

5. The clip according to claim 1, wherein each said spaced arm having an area with a reduced thickness and each said bracing element extends from said area to the first surface.

6. The clip according to claim 1, wherein the support structure member having a plurality of apertures therealong, and the spaced arms having aligned through bores adapted for positioning for coinciding with a selected one of the apertures to form a channel to receive the securing means.

7. The clip according to claim 1, wherein the securing means includes an elongate member detachably connected to the main body portion, or integrally formed with a cord-like extension joined to the main body portion.

8. The clip according to claim 7, wherein the cord-like extension having enlarged sections where it is formed with the elongate member and the main body portion.

9. The clip according to claim 1, wherein the securing means is arranged to be co-operable with the engagement arrangement for removably fixing the clip in position relative to the support structure member.

10. The clip according to claim 1, wherein the support post being in the form of a fence post or stake.

11. A fencing system including a plurality of spaced vertically positioned support posts each having at least one vertically extending structure member with opposed edge surfaces, and a fencing extending horizontally for attachment to the support posts, the fencing being in the form of a flexible barrier netting with openings, including at least one clip according to claim 1 associated with each post structure for removably supporting the said fencing to the plurality of support posts.

12. A clip for securing fencing to a support post having at least one vertically extending support structure member with opposed edge surfaces, the fencing being in the form of a flexible barrier netting with openings, comprising:

a main body portion having a first and second surface, attachment means extending from said first surface and having an engagement arrangement for removably engaging with at least one edge surface of the support post and securing means for removably securing the engagement arrangement in position relative to the support post, the engagement arrangement having two spaced arms extending from said first surface and a recess formed between the spaced arms, the recess being adapted for receiving said edge surfaces when in engagement with said support post, the support post having a plurality of apertures therealong, and the spaced arms having aligned through bores adapted for positioning for coinciding with a selected one of the apertures to form a channel to receive the securing means, and retaining means extending from said second surface, said retaining means being configured for removably supporting the barrier netting relative to the support post by engaging the retaining means with the barrier netting at a selected one of the openings, said retaining means having a curved support portion extending from said second surface to a free end in a first direction, and a curved retainer portion being spaced from said support portion and extending from said second surface to a free end in a second direction opposite to and in vertical alignment with said first direction, said support portion and said retainer portion being configured so that in engagement with the barrier netting both the support portion and the retainer portion extend through said selected one of the openings, and the free ends of the support portion and the retainer portion and the main body portion being adapted to confine movement of the fencing therebetween and thereby restricting movement of the fencing relative to the support post.

13. The clip according to claim 12, further including a first bracing means connected between the first surface and the attachment means for providing a bracing support to the attachment means and a second bracing means connected between the second surface and the retaining means for providing a bracing support to the retaining means.

14. The clip according to claim 13, wherein the second bracing means being in the form of a buttress element connected between the second surface and the support portion or the retainer portion.

15. The clip according to claim 12, wherein the spaced arms being a bifurcation adapted for press-fitting engagement with the edge surfaces of the support structure member.

16. The clip according to claim 12, wherein including a first bracing means having a bracing element connected between each of the spaced arms and the first surface.

17. The clip according to claim 16, wherein each said spaced arm having an area with a reduced thickness and each said bracing element extends from said area to the first surface.

18. The clip according to claim 12, wherein the securing means includes an elongate member detachably connected to the main body portion, or integrally formed with a cord-like extension joined to the main body portion.

19. The clip according to claim 18, wherein the cord-like extension having enlarged sections where it is formed with the elongate member and the main body portion.

20. The clip according to claim 12, wherein the securing means is arranged to be co-operable with the engagement arrangement for removably fixing the clip in position relative to the support structure member.

21. The clip according to claim 12, wherein the support post being in the form of a fence post or stake.

22. A fencing system including a plurality of spaced vertically positioned support posts each having at least one vertically extending structure member with opposed edge surfaces, and a fencing extending horizontally for attachment to the support posts, the fencing being in the form of a flexible barrier netting with openings, including at least one clip according to claim 12 associated with each support post for removably supporting the said fencing to the plurality of support posts.

23. A clip for securing fencing to a support post having at least one vertically extending support structure member with opposed edge surfaces, the fencing being in the form of a flexible barrier netting with openings, comprising:

a main body portion having a first and second surface, attachment means extending from said first surface and having an engagement arrangement for removably engaging with said at least one edge surface of the support post and securing means for removably securing the engagement arrangement in position relative to the support post, the securing means having an elongate member detachably connected to the main body portion, or integrally formed with a cord-like extension joined to the main body portion, and retaining means extending from said second surface, said retaining means being configured for removably supporting the barrier netting relative to the support post at a selected one of the openings, said retaining means having a curved support portion extending from said second surface to a free end in a first direction, and a curved retainer portion being spaced from said support portion and extending from said second surface to a free end in a second direction opposite to and in vertical alignment with said first direction, said support portion and said retainer portion being configured so that in engagement with the barrier netting both the support portion and the retainer portion extend through said selected one of the openings, and the free ends of the support portion and the retainer portion and the main body portion being adapted to confine movement of the fencing therebetween and thereby restricting movement of the fencing relative to the support post.

24. The clip according to claim 23, further including a first bracing means connected between the first surface and the attachment means for providing a bracing support to the attachment means and a second bracing means connected between the second surface and the retaining means for providing a bracing support to the retaining means.

25. The clip according to claim 24, wherein the second bracing means being in the form of a buttress element connected between the second surface and the support portion or the retainer portion.

26. The clip according to claim 23, wherein the engagement arrangement having a recess adapted for receiving said edge surfaces when in engagement with said support structure member.

27. The clip according to claim 26, wherein the engagement arrangement include two spaced arms extending from said first surface and said recess being formed between the spaced arms.

28. The clip according to claim 27, wherein the spaced arms being a bifurcation adapted for press-fitting engagement with the edge surfaces of the support structure member.

29. The clip according to claim 27, wherein further having first bracing means includes a bracing element connected between each of the spaced arms and the first surface.

30. The clip according to claim 29, wherein each said spaced arm having an area with a reduced thickness and each said bracing element extends from said area to the first surface.

31. The clip according to claim 27, wherein the support structure member having a plurality of apertures therealong, and the spaced arms having aligned through bores adapted for positioning for coinciding with a selected one of the apertures to form a channel to receive the securing means.

32. The clip according to claim 23, wherein the cord-like extension having enlarged sections where it is formed with the elongate member and the main body portion.

33. The clip according to claim 23, wherein the securing means is arranged to be co-operable with the engagement arrangement for removably fixing the clip in position relative to the support structure member.

34. The clip according to claim 23, wherein the fencing being in the form of a lightweight flexible fencing material including a barrier netting with openings selectively positionable for one of the openings to be supported by the retaining means, and the support post being in the form of a fence post or stake.

35. A fencing system including a plurality of spaced vertically positioned support posts each having at least one vertically extending structure member with opposed edge surfaces, and a fencing extending horizontally for attachment to the support posts, the fencing being in the form of a flexible barrier netting with openings, including at least one clip according to claim 23 associated with each support post for removably supporting the said fencing to the plurality of support posts.

* * * * *